United States Patent [19]

Kim et al.

[11] Patent Number: 4,602,207

[45] Date of Patent: Jul. 22, 1986

[54] TEMPERATURE AND POWER SUPPLY STABLE CURRENT SOURCE

[75] Inventors: Suk K. Kim, Brooklyn Park, Minn.; Edward J. Zimany, Jr., Morristown, N.J.

[73] Assignee: AT&T Bell Laboratories, Murray Hill, N.J.

[21] Appl. No.: 593,522

[22] Filed: Mar. 26, 1984

[51] Int. Cl.[4] ..... G05F 3/16

[52] U.S. Cl. ..... 323/313; 307/296 R; 323/907

[58] Field of Search ..... 307/296, 297; 323/314, 323/315, 316, 313

[56] References Cited

U.S. PATENT DOCUMENTS

| | | | |
|---|---|---|---|
| Re. 30,586 | 4/1981 | Brokaw | 323/314 |
| 2,996,918 | 8/1961 | Hunter | 307/310 |
| 3,158,822 | 11/1964 | Brechling | 307/310 |
| 3,956,645 | 5/1976 | Boer | 307/297 |
| 4,263,519 | 4/1981 | Schade, Jr. | 307/297 |
| 4,427,903 | 1/1984 | Sugimoto | 307/297 |
| 4,446,419 | 5/1984 | Plassche | 307/297 |

OTHER PUBLICATIONS

"Precision Current Source", by J. L. Sanford; IBM Technical Disclosure Bulletin; vol. 18, No. 9, Feb. 1976, pp. 2946–2947.

*Primary Examiner*—John S. Heyman
*Assistant Examiner*—Karl Ohralik
*Attorney, Agent, or Firm*—David I. Caplan

[57] ABSTRACT

Current source circuitry consisting of a first n-channel field effect transistor (FET) and voltage generator circuitry coupled to the gate of the first FET. The voltage generator circuitry acts to control the current through the first FET such that it is essentially constant even with power supply, temperature, and many processing variations. The voltage generator circuitry consists of a second FET, a two input differential operational amplifier, a resistor, and an n-p-n transistor if the resistor has a positive temperature coefficient. A negative feedback path using the amplifier and the second FET ensures against current changes in the first and second FETs even if there are changes in one of the power supply levels and/or many semiconductor processing variations.

9 Claims, 1 Drawing Figure

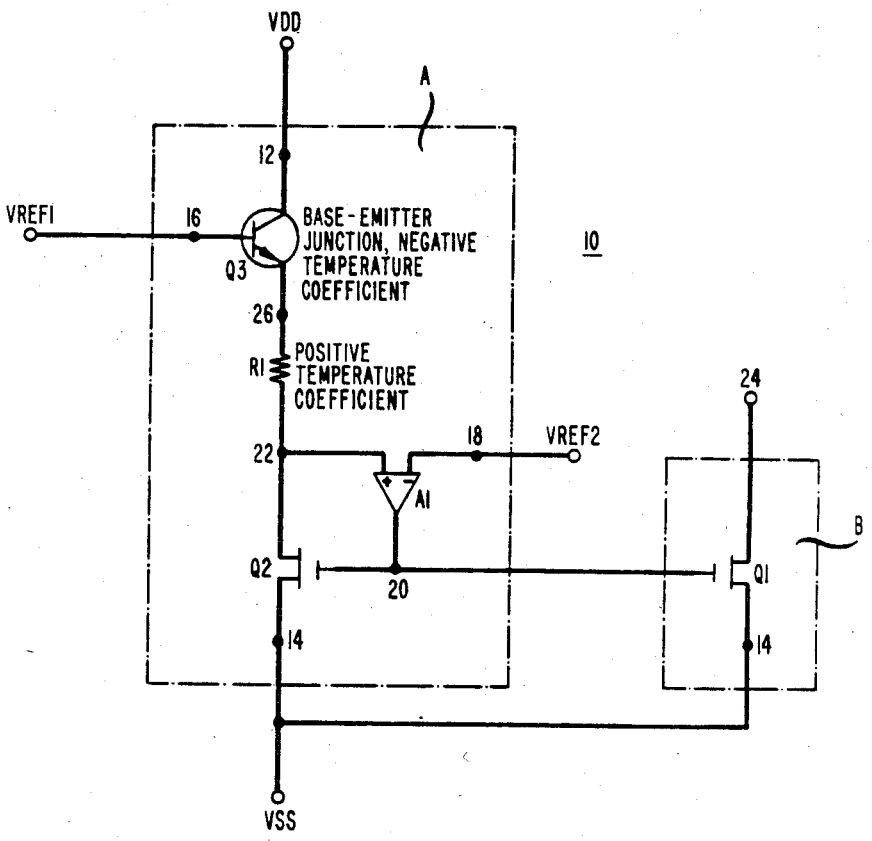
VDD
A
12
VREFI
16
BASE-EMITTER
JUNCTION, NEGATIVE
TEMPERATURE
COEFFICIENT
Q3
10
26
R1
POSITIVE
TEMPERATURE
COEFFICIENT
24
22
18
VREF2
A1
B
Q2
20
Q1
14
14
VSS

TEMPERATURE AND POWER SUPPLY STABLE CURRENT SOURCE

TECHNICAL FIELD OF INVENTION

This invention relates to voltage generation circuitry, and in particular, to voltage generator circuitry which is used to bias a current source such that the current flow is relatively stable.

BACKGROUND OF THE INVENTION

Many of today's field effect transistor circuits use current mirrors each of which comprise essentially a field effect transistor with the source connected to a power supply and the gate terminal connected to a potential which is of sufficient magnitude and correct polarity to allow the desired current level to flow through the transistor. If the gate terminal potential is held fixed and the power supply potential connected to the source terminal of the transistor varies, the gate to source potential of the transistor changes. This changes the current flowing in the mirror. Many applications require that the current flow be at a preselected level, and remain at or very near that level independent of power supply, temperature, and most processing changes. Some of the available current sources do not adequately meet these requirements, or use one or more off chip components.

It is desirable to have a transistor type current source with the gate terminal coupled to voltage generator circuitry which causes a relatively constant current level to flow through the transistor even with power supply, temperature, and processing variations, with all components on chip. Many applications also require the absence of switching noise, precluding switched capacitor approaches.

SUMMARY OF THE INVENTION

The present invention is directed to circuitry which uses one or more reference voltages to generate a current which stays essentially constant even when the levels of the power supplies used with the circuitry and the temperature vary. Depending on the type of resistor used, the current generated by the circuitry is insensitive to most semiconductor processing variations and generates no switching noise. The circuitry of a preferred embodiment comprises a first n-channel field effect transistor through which the desired current flows and voltage generator circuitry coupled to the gate of the first transistor for controlling the current flow therethrough. The voltage generator circuitry comprises a two input differential operational amplifier, a second field effect transistor, a p-type silicon resistor, and an n-p-n transistor. The negative input terminal of the amplifier is coupled to a second reference potential VRef2. The positive input terminal of the amplifier is coupled to the drain of the second transistor and to a first terminal of the resistor. A second terminal of the resistor is coupled to the emitter of the n-p-n transistor. The output terminal of the amplifier is coupled to the gates of the first and second field effect transistors which have their source terminals coupled to a common first power supply VSS. The base and collector of the n-p-n transistor are coupled to a first reference potential VRef1 (typically ground) and to a second power supply VDD, respectively.

Another embodiment of the present invention does not use the n-p-n transistor and couples the second terminal of the resistor to a reference potential which can be the first reference potential or ground. If the resistor selected is of a type which essentially does not change ohmic value with temperature variations, the current will be stable with temperature variations.

Viewed from another aspect, the present invention is directed to circuitry comprising a first device having a control terminal and first and second output terminals, a second device of the same type as the first device, resistive means having first and second output terminals, and a differential amplifier having a positive and negative input terminal and an output terminal. The output terminal of the amplifier is coupled to the control terminals of the first and second devices. The second output terminals of the first and second devices are coupled together and are connectable to a first power supply. The positive input terminal of the amplifier is coupled to the first terminal of the resistive means and to the first output terminal of the second device. The second terminal of the resistive means is connectable to a first reference potential. The negative input terminal of the amplifier is coupled to the second reference potential.

These and other features and advantages of the invention are better understood from a consideration of the following detailed description taken in conjunction with the accompanying drawings.

BRIEF DESCRIPTION OF THE DRAWING

The FIGURE illustrates circuitry in accordance with one embodiment of the present invention.

DETAILED DESCRIPTION

Referring now to the FIGURE, there is illustrated current source circuitry 10 in accordance with the present invention comprising voltage generator circuitry illustrated within dashed-lined rectangle A and denoted as A and current generator circuitry illustrated within dashed-lined rectangle B and denoted as B. In a preferred embodiment, circuitry B comprises an n-channel field effect transistor Q1. Voltage generator circuitry A comprises an n-channel field effect transistor Q2, an n-p-n transistor Q3, a resistor R1, a differential input amplifier A1 having a positive input terminal, a negative input terminal, and an output terminal. Circuitry 10 causes a current to flow through Q1 which has a preselected value which stays essentially constant with variations in temperature and with power supplies utilized with circuitry 10. The drain of Q1 is coupled to a terminal 24 to which a circuit (not illustrated) requiring an essentially constant current is coupled. Each of transistors Q1, Q2, or Q3 may be referred to as a device having a control terminal and first and second output terminals with current flow through the device being controlled by potentials applied to and/or currents supplied to the control terminal.

The collector of Q3 is connected to a terminal 12 and to a power supply VDD. The sources of Q1 and Q2 are coupled to a terminal 14 and to a power supply VSS. The base of Q3 is coupled to a terminal 16 and to a reference voltage VRef1. The negative input terminal of A1 is coupled to a terminal 18 and to a second reference voltage VRef2. The emitter of Q3 is coupled to one terminal of R1 and to a terminal 26. The positive input terminal of A1 is coupled to a second terminal of R1, to the drain of Q2, and to a terminal 22. The output terminal of A1 is coupled to the gates of Q1 and Q2 and to a terminal 20.

Amplifier A1 automatically adjusts the voltage at terminal 20 to a level which biases Q2 such that the current flowing through Q2 causes the voltage at terminal 22 to be at a level close to the level of VRef2. The negative feedback from terminal 22 through A1 and then through Q2 serves to set the potential of terminal 22 at a level which is relatively insensitive to variations in VSS, temperature, or semiconductor processing.

Typically amplifier A1 uses field effect transistors and is fabricated on the same silicon chip as Q1, Q2, Q3, and R1. In a preferred embodiment, A1 comprises complementary metal-oxide-silicon transistors. R1 is a silicon resistor which is typically characterized by a positive temperature coefficient. One characteristic of the emitter-base p-n junction of Q3 is a negative temperature coefficient. If the difference between VRef2 and VRef1 is chosen properly, the series combination of the emitter-base junction of Q3 and R1 causes effective cancellation of their temperature coefficients. Accordingly, the current through Q3, R1, and Q2 stays essentially constant with temperature variation over a useful temperature range of typically −40 degrees C. to 100 degrees C. Therefore, the current through mirror Q1 also remains essentially constant.

VRef1 and VRef2 are selected to be well-regulated supply sources with typically one of the same being ground potential. Q3 functions as an emitter-follower and as such variations in the level of VDD essentially do not affect the potential of terminal 26 which follows the potential of terminal 16. Accordingly, variations in VDD have very little effect on the current flowing through Q3, R1, and Q2 and therefore little effect on the current flowing through Q1. Accordingly, the current flowing through Q1 is essentially constant even with variations in VDD, VSS, temperature, and most processing parameters.

Variations in semiconductor processing which affect amplifier 10, Q1, and Q2 have little effect on the current generated in Q1 and Q2. Semiconductor processing variations which affect the emitter-base junction of Q3, or the ohmic value of R1, do to some extent affect the current levels through Q1 and Q2. However, this can typically be held to a few percent.

The circuitry of the FIGURE has been fabricated on a single silicon chip and found to be fully functional with VDD=+5.00 volts, VSS=−5.00 volts, VRef1=0 volts, VRef2=−0.91 volts, R1=10,000 ohms, amplifier A1 being a CMOS operational amplifier having a gain of approximately 10,000, and the current levels through Q1 and Q2 being 25 microamperes each. Amplifier A1 typically has relatively low output impedance and therefore can drive many current generator circuitries (transistors). Variations of ±10 percent in the level of VSS resulted in less than a 1 percent change in the mirrored current through Q1. Variations of ±10 percent in the level of VDD resulted in less than 0.50 percent change in the current through Q1. The current through Q1 varied by approximately 0.08 percent/degrees C.

Circuitry 10, without Q3 and with terminal 18 connected to VDD, is described in U.S. patent application Ser. No. 566,822 (C. F. Rahim Case 1), filed Dec. 29, 1983, and in U.S. patent application Ser. No. 566,823 (C. F. Rahim Case 2), filed Dec. 29, 1983. The present application and C. F. Rahim Cases 1 and 2 all have a common assignee.

The embodiments described herein are intended to be illustrative of the general principles of the present invention. Various modifications are possible consistent with the spirit of the invention. For example, Q3 may be eliminated in some applications and terminal 26 of R1 can be connected to a reference potential or to a power supply or to ground potential. Thus, depending on the sensitivity of R1, this can result in an overall circuit which has more sensitivity to temperature variations then circuitry 10. Still further, Q2 could be replaced by a plurality of devices like Q2 which are essentially in parallel with all the gates being common, all the drains being common, and all the sources being common. Still further, Q2 could be replaced with two separate devices serially connected together. Still further, R1 can be a depletion mode field effect transistor. Still further, Q3 can be a field effect transistor. Still further, a p-n diode can be substituted for Q3 with the anode coupled to a reference potential or to VDD and with the cathode coupled to terminal 26. Still further, Q1 and Q2 can be bipolar transistors, junction field-effect transistors, or other types of devices. Still further, a configuration of two bipolar transistors with the collectors being common and being connected to VDD, the emitter of the first coupled to the base of the second, and the emitter of the first connected to terminal 26, can be substituted for Q3. Such a configuration provides more flexibility in selecting the values of R1, VRef2, and reduces the current sensitivity to amplifier offsets.

What is claimed is:

1. Circuitry comprising:

a first transistor having a control terminal and first and second output terminals;

a second transistor, of the same type as the first transistor, having a control terminal and first and second output terminals;

resistive means having first and second terminals and characterized by a positive temperature coefficient;

a differential amplifier having a positive and a negative input terminal and an output terminal;

the output terminal of the amplifier being coupled to the control terminals of the first and second devices;

the positive input terminal of the amplifier being coupled to the second terminal of the resistive means and to the first output terminal of the second device;

a p-n junction device having a p-n junction formed at a junction of first and second semiconductor regions, said first and second regions being respectively contacted by first and second terminals of the junction device, said p-n junction being characterized by a negative temperature coefficient, the first terminal of the device being connectable to a first reference potential, the second terminal of the device being coupled to the first terminal of the resistive means, the negative input terminal of the amplifier being connectable to a second reference potential; and the second output terminals of the first and second transistors being connectable to a first power supply potential.

2. The circuitry of claim 1 in which the first and second regions are the base and emitter regions, respectively, of a bipolar transistor having a collector terminal which is connectable to a second power supply potential.

3. The circuitry of claim 1 wherein:

the first and second transistors are insulated gate field effect transistors; and the resistive means is a resistor.

4. The circuitry of claim 3 wherein:

the field effect transistors are n-channel enhancement mode devices;

the p-n junction device is an n-p-n type bipolar transistor; and the resistor is a p-type silicon resistor.

5. The circuitry of claim 3 wherein:

the field effect transistors are p-channel enhancement mode devices;

the bipolar transistor is a p-n-p type transistor; and the resistor is a p-type silicon resistor.

6. Voltage generator circuitry, coupled to a control terminal of a first transistor device having first and second output terminals and the control terminal, comprising:

a second transistor device of the same type as the first device having a control terminal and first and second ouput terminals;

resistive means, characterized by a positive temperature coefficient, having first and second terminals;

a differential amplifier having negative and positive input terminals and an output terminal;

the output terminal of the amplifier being coupled to the control terminals of the first and second devices;

the positive input terminal of the amplifier being coupled to the second terminal of the resistive means and to the first output terminal of the second device;

a bipolar transistor having a base-emitter junction which is characterized by a negative temperature coefficient, having a base terminal connectable to a first reference potential, and having an emitter terminal coupled to the first terminal of the resistive means, the negative input terminal of the amplifier being connectable to a second reference potential, the second terminals of the first and second devices being connectable to a first power supply potential, and the collector terminal of the bipolar transistor being connectable to a second power supply potential.

7. The circuitry of claim 6 wherein:

the first and second transistor devices are insulated gate field effect transistors; and the resistive means is a resistor.

8. The circuitry of claim 7 wherein:

the field-effect transistors are n-channel enhancement mode devices;

the bipolar transistor is an n-p-n type transistor; and the resistor is a p-type silicon resistor.

9. The circuitry of claim 8 wherein:

the field-effect transistors are p-channel enhancement mode devices;

the bipolar transistor is a p-n-p type transistor; and the resistor is a p-type silicon resistor.

* * * * *